US008399789B2

(12) United States Patent
Nishino et al.

(10) Patent No.: US 8,399,789 B2
(45) Date of Patent: Mar. 19, 2013

(54) KEYBOARD

(75) Inventors: Takeshi Nishino, Shinagawa (JP); Shuji Nakamua, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 1048 days.

(21) Appl. No.: 12/379,934

(22) Filed: Mar. 4, 2009

(65) Prior Publication Data

US 2009/0224948 A1 Sep. 10, 2009

(30) Foreign Application Priority Data

Mar. 4, 2008 (JP) ..... 2008-053614

(51) Int. Cl.
*H01H 13/70* (2006.01)

(52) U.S. Cl. ..... 200/345

(58) Field of Classification Search ..... 200/345, 200/341, 5 A, 5 R, 314; 341/22
See application file for complete search history.

(56) References Cited

U.S. PATENT DOCUMENTS

| | | | | |
|---|---|---|---|---|
| 5,380,969 | A * | 1/1995 | Yang | 200/517 |
| 6,239,391 | B1 * | 5/2001 | Nishijima et al. | 200/5 A |
| 6,743,993 | B1 * | 6/2004 | Clark et al. | 200/314 |
| 7,514,643 | B1 * | 4/2009 | Tittle | 200/314 |

FOREIGN PATENT DOCUMENTS

| | | |
|---|---|---|
| JP | 62-142892 | 9/1987 |
| JP | 2-76436 | 6/1990 |
| JP | 5-20967 | 1/1993 |
| JP | 5-166437 | 7/1993 |
| JP | 7-70273 | 7/1995 |

OTHER PUBLICATIONS

Japanese Office Action issued Jun. 5, 2012 in corresponding Japanese Patent Application No. 2008-053614.

* cited by examiner

*Primary Examiner* — Edwin A. Leon
(74) *Attorney, Agent, or Firm* — Staas & Halsey LLP

(57) ABSTRACT

A keyboard having: a base panel, a switch panel including a hole portion, a membrane sheet including a contact portion, a key top adapted to be depressed for switching the contact portion ON, and a housing supporting and guiding the key top to move freely in a vertical direction, including each a tube portion on an upper end side having a guide hole formed for inserting a stem formed integrally with the key top and a flange portion on an lower end side extending laterally around the tube portion in a size larger than the hole portion; wherein the housing is inserted into the hole portion from a back side of the switch panel, the flange portion being attached to the back side of the switch panel.

4 Claims, 5 Drawing Sheets

KEYBOARD

CROSS REFERENCE TO RELATED APPLICATIONS

The present application claims the benefit of priority based on Japanese Patent Application No. 2008-053614, filed on Mar. 4, 2008, disclosure of which is incorporated herein in its entirety by reference.

BACKGROUND OF THE INVENTION

1. Field of the Invention

The present invention relates to a keyboard having a plurality of key tops which are supported so as to permit relative movement with respect to a substrate.

2. Description of Related Art

In general, a keyboard is used as an input device in the field of an electronic apparatus such as a desk-top personal computer, and the like. A keyboard has a plurality of key tops having a contact type switch on the underside thereof. A key top is mounted with an axis portion slidably fitted into a housing having a guide hole, and can slide vertically up and down along the guide hole. When the key top is depressed against an elastic force of a resilient member such as a rubber sheet or a spring, a switch is depressed in interlock with the movement of the key top. The key top can be pulled upward to be removed from the housing, and then the rubber member can be replaced in order to customize the feeling of key touch.

An example of a conventional key top is disclosed in Japanese Patent Publication (Kokoku) No. H07-70273 (JP-07-70273-B1). On page 3, lines 22-44, JP-07-70273-B1 includes a description that "Housing 30 is generally comprised of housing portion 31, flange 32, leg portion 33, engaging claw 34, and bottom plate 35. Flange 32 extends laterally from the lower portion of both sides of housing portion 31, and as shown together in FIG. 3, its end is inclined a little downward from horizontal direction to provide abutting portion 32*a* for abutting to panel 11. Flange 32 has elasticity in a direction of Z-axis. In attached state, bottom plate 35 is provided at the height of base portion of flange 32 so as to form a gap to panel 11. Leg portion 33 and engaging claw 34 form a pair, and have same width dimension in the direction of Y-axis, and are respectively provided to project from both side ends of the lower surface of bottom plate 35. Engaging claw 34 has arm portion 34*b* and claw portion 34*a* at its lower end. Arm portion 34*b* is formed with thinner wall as compared to leg portion 33, and has elasticity in a direction of X-axis. Claw portion 34*a* has engaging surface 34*c* that engages with the lower surface of panel 11 in the state with housing 30 having been attached."

Also, Japanese Patent Publication (Kokai) No. H05-166437 (JP-05-166437-A1) discloses another example of conventional keyboard. In paragraph 0011 to 0015, JP-05-166437-A1 includes a description that "Stem 3 which is disposed in housing 2 and moves vertically in housing 2, is integrally fitted to key top 1 that is operated by depression with a finger. At the position opposed to stem 3, rubber 5, membrane sheet 6, and leg portions 4 penetrating through mounting plate 8 are provided, and hooks 4*a* are formed at the distal ends of leg portions 4. Rubber 5, membrane sheet 6 having movable contact 7*a* and fixed contact 7*b*, and mounting plate 8 are respectively disposed at the lower portion of housing 2. Rubber 5 abuts to the lower face of stem 3 and deforms when a depressing force acts on key top 1, and with this deformation presses membrane sheet 6 to bring movable contact 7*a* into contact with fixed contact 7*b*. Rubber 5 functions, when the depressing force is released, so as to release the deformation, and restore key top 1 to the initial state. At the positions of rubber 5 corresponding to leg portions 4 of stem 3, holes 5*a* for inserting leg portions 4 are formed. At corresponding positions of membrane sheet 6 and mounting plate 8, holes 6*a*, 8*a* for inserting hooks 4*a* formed at the distal ends of leg portions 4 of stem 3 are respectively formed. Therefore, the size of holes 6*a*, 8*a* is larger than the size of holes 5*a*."

In a keyboard having the construction in which individual pieces of housings are attached to a switch panel, wherein the keyboard has the structure such that housings are attached from the front side of the switch panel, a direction for removing a key top is same as a direction of pulling out a housing, and therefore, there is a problem that the housing may come out unintentionally together with the key top.

SUMMARY OF THE INVENTION

It is an object of the present invention to provide a keyboard which can prevent housing from coming out unintentionally together with a key top when a key top has to be removed. Further, it is another object of the present invention to provide a keyboard which exhibits an improved reliability of switching operation of a membrane sheet.

In order to resolve the above-described problem, in accordance with an aspect of the present invention, there is provided a keyboard having a base panel, a switch panel which has a hole portion at predetermined position and is disposed on an upper side of the base panel, a membrane sheet which has a contact portion and is disposed between the base panel and the switch panel, a key top which are supported on an upper surface of the switch panel and are adapted to be depressed for switching the contact portion, and a stepped tubular housing which support and guide the key top vertically in up/down direction and which each has a tube portion having a guide hole formed on an upper end for inserting a stem provided integrally with the key top, and on an upper end, has a flange portion that extends laterally around the tube portion and is of a size larger than the hole portion, wherein the housing is inserted from a back side of the switch panel into the hole portion, and wherein the flange portion is attached to a back side of the switch panel.

In accordance with the above-described construction, a direction in which the key top is removed from the keyboard is contrary to a direction in which the housing is pulled off, so that the housing is prevented from coming out together with the key top.

In the above-described keyboard, it is possible to provide a plurality of leg portions on a lower surface of the flange portion capable of abutting to the base panel and to provide a plurality of insertion holes for inserting the leg portions in the membrane sheet at positions corresponding to the leg portions, such that a length of each leg portion is greater than the thickness of the membrane sheet. With such construction, since the leg portions provided on the lower surface of the flange portion are inserted through the insertion holes provided in the membrane sheet so as to abut to the base panel, the membrane sheet is prevented from being pressed by the leg portions. Therefore, expansion and shrinkage of the membrane sheet due to variation of temperature or humidity are not hampered, and troubles in switch operation can be avoided.

In the above-described keyboard, it is possible to provide at least two leg portions at positions that are rotationally symmetric with respect to a center of the flange portion. With such construction, since at least two leg portions are provided in rotational symmetry, the housing can be supported in good balance on the base panel.

In the above-described keyboard, it is also possible to form the flange portion in a shape of a square, and to provide two or four leg portions so as to form each pair in each diagonal direction of the flange, and to provide two or four insertion holes capable of accommodating two or four leg portions. With such construction, when the keyboard is assembled, the housing can be attached to the switch panel at each position rotated by 90 degrees. Thus, a degree of freedom for attaching the housing is increased, and workability of keyboard assembling is improved.

BRIEF DESCRIPTION OF THE DRAWINGS

The above and other objects, features and advantages of the present invention will become more apparent from reading following description of the preferred embodiments with reference to appended drawings, in which.

DETAILED DESCRIPTION

Figure 1:
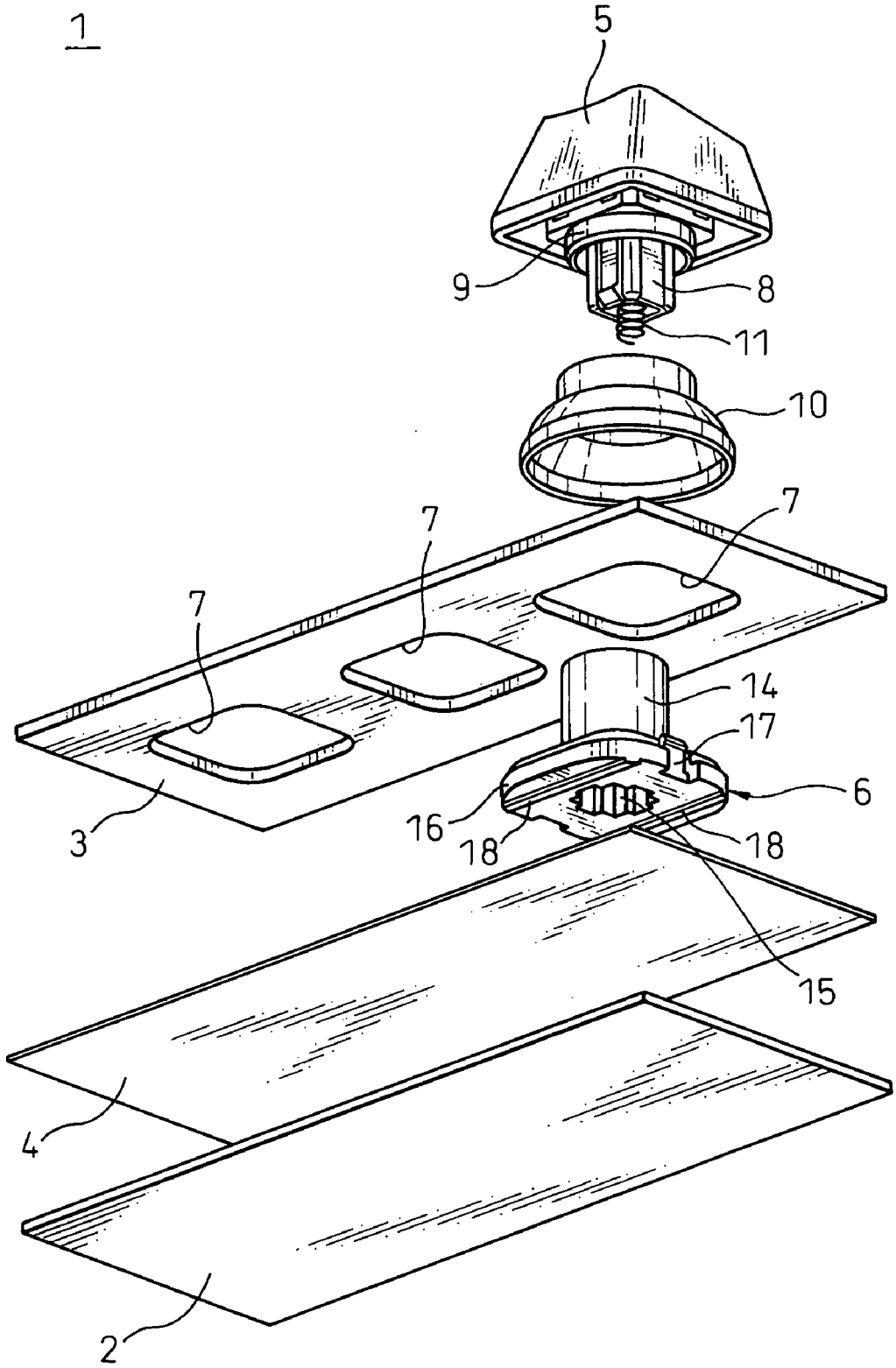
FIG. 1 is an exploded perspective view of a keyboard according to a first embodiment of the present invention.
Figure 2:
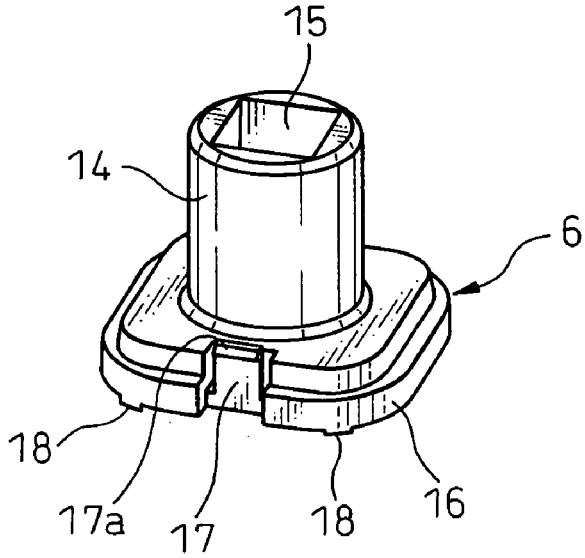
FIG. 2 is a perspective view of the housing as shown in FIG. 1.
Figure 3:
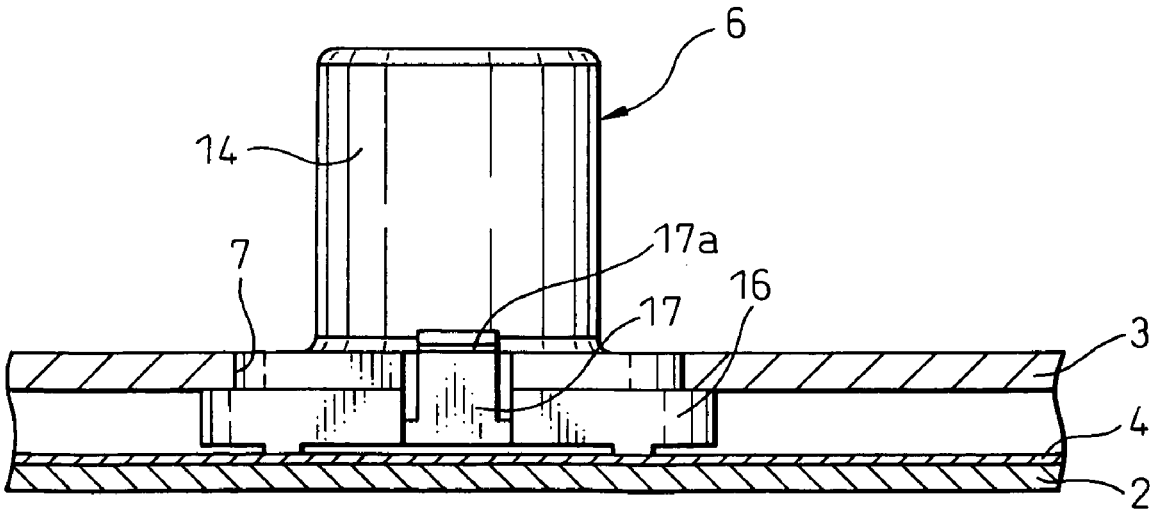
FIG. 3 is a sectional view of the housing attached to the back surface of the switch panel.

The present invention will be described in detail below with reference to drawings showing specific examples according to embodiments of the invention. FIGS. 1 to 3 show a keyboard according to a first embodiment of the present invention.

FIG. 1 is a view of the basic structure of keyboard 1 of this embodiment. Keyboard 1 has base panel 2 and switch panel 3 which are disposed in opposition to each other in a vertical direction, a multiplicity of vertically opposed pairs of contact portions 26*a*, 26*b* (see FIG. 7), membrane sheet 4 disposed between base panel 2 and switch panel 3, key tops 5 which are supported on the upper surface of switch panel 3 and are adapted to be depressed for switching contact portions 26*a*, 26*b* on membrane sheet 4, and housings 6 which support and guide key tops 5 vertically in up/down direction.

Switch panel 3 is a monolithic metal plate and has a multiplicity of square attaching holes for mounting housings 6 which support key tops 5. Membrane sheet 4 has a laminated structure including upper electrode sheet 25*a*, lower electrode sheet 25*b*, and insulating sheet 25*c* between upper and lower electrode sheets 25*a*, 25*b* (see FIG. 7). A pair of upper and lower contact portions 26*a*, 26*b* of membrane sheet 4 is disposed at a position corresponding to stem 8 of individual key top 5. Insulating sheet 25*c* is cut at the position of contact portions 26*a*, 26*b* so as to permit upper and lower electrode sheets 25*a*, 25*b* to come into contact with each other. When electrode sheets 25*a*, 25*b* are pressed by stem 8, the pair of contact portions 26*a*, 26*b* comes into mutual contact and the switch is turned ON, and when the pair of contact portions 26*a*, 26*b* is separated, the switch is turned OFF.

Key top 5 is fitted into stem 8 or formed integrally with stem 8 to form a depression portion. Stem 8 has stem ring 9 integrally formed at the base side. An opening end at the smaller diameter side of dome-shaped cup rubber 10 is pressed into stem ring 9. An opening end of cup rubber 10 at the larger diameter side abuts to the surface of switch panel 3. Coil spring 11 is provided on stem 8 so as to project downward from the lower surface. The projecting end of the coil spring is adapted to press the contact portion of membrane sheet 4 when key top 5 is depressed. In the keyboard of this embodiment, stem 8 is elastically supported by cup rubber 10 and coil spring 11, so that a user of the keyboard can change the type of cup rubber 10 and coil spring 11 in order to obtain a key touch feeling that is the most suitable for the user.

As shown in FIG. 2, housing 6 supports and guides stem 8 so as to permit free vertical movement thereof, and one housing is formed for each key top 5. Housing 6 has tube portion 14 having guide hole 15 formed at the upper end for inserting stem 8, and flange portion 16 extending laterally around tube portion 14 at the lower end, thus forming a shape of stepped tube as a whole. Tube portion 14 is formed in the shape of circular tube, and has square guide hole 15 formed in the center for inserting square shaped stem 8. Since tube portion 14 is formed in size smaller than the size of attaching hole 7 of switch panel 3, when housing 6 is attached to switch panel 3 from the back surface side, tube portion 14 projects from the back surface side to the front surface side of switch panel 3 (FIG. 3). Since flange portion 16 is formed in size larger than the size of attaching hole 7, housing 6 is prevented from being unintentionally pulled out toward the front surface side of switch panel 3, for example, together with key top 5.

Flange portion 16 is formed in a shape of a square, and has engaging pieces 17 formed on two opposing sides. Claw portion 17*a* is formed facing outward at the distal end of engaging piece 17. When housing 6 is attached to attaching hole 7 of switch panel 3 from the back surface side thereof, claw portion 17*a* is latched on the circumferential wall of attaching hole 7. Thus, housing 6 is prevented from carelessly falling off from attaching hole 7 of switch panel 3 at the time of assembly of keyboard 1. When the assembly of keyboard 1 is completed, flange portion 16 is sandwiched between switch panel 3 and membrane sheet 4.

In this embodiment, a pair of rails 18 is provided in parallel to each other on the lower surface of flange portion 16 from one of opposing sides to the other of the opposing sides. As shown in FIG. 3, when the lower surface of rails 18 comes into contact with the upper surface of membrane sheet 4, housing 6 is closely sandwiched between switch panel 3 and membrane sheet 4 without gap. Since membrane sheet 4 is supported on base panel 2, membrane sheet 4 is prevented from being deformed when key top 5 is depressed.

As has been described above, in accordance with the present embodiment, housing 6 is attached from the back surface side of switch panel 3, and since housing 6 has flange portion 16 of size larger than the size of attaching hole 7, housing 6 is prevented from carelessly coming off toward the front surface side of switch panel 3 by flange portion 16 being caught at attaching hole 7.

Next, referring to FIGS. 4 to 7, a keyboard according to a second embodiment of the present invention will be described. Keyboard 1A of this embodiment differs from keyboard 1 of the first embodiment in that a plurality of leg portions 20 are formed on the back surface of housing 6A (flange portion 16A) that supports key top 5. Other components are common to keyboard 1 of the first embodiment. In this embodiment, description of the components common to the first embodiment will be omitted, and only the difference of the construction between the two embodiments will be described.

In general, the membrane sheet is formed from resin material such as polyethylene terephthalate (PET), and therefore, expands or shrinks due to temperature variation or humidity variation. Specifically, expansion or shrinkage of membrane 4 having laminated structure may appear as the deformation or flexure of upper and lower electrode sheet 25*a*, 25*b*, and electrode 26*a*, 26*b* provided on upper and the lower electrode sheet 25*a*, 25*b* disposed with a predetermined gap may unintentionally come into contact with each other. Therefore, a keyboard that is to be used in places where variation of temperature or humidity is large should be designed so as to tolerate expansion or flexure of the membrane sheet and the membrane sheet should be designed so as not to be fixed in the keyboard.

In this embodiment, a plurality of leg portions 20 that are capable of abutting to base panel 2 are provided on the lower surface of flange portion 16A, and a plurality of insertion holes 21 for inserting leg portions 20 are provided in membrane sheet 4A, and leg portions 20 are formed longer in length than the thickness of membrane sheet 4A. Thus, leg portions 20 provided on the lower surface of flange portion 16A are prevented from interfering with membrane sheet 4A. Therefore, even when flange portion 16A of housing 6A is sandwiched between switch panel 3 and membrane sheet 4A, housing 6A is supported via legs 20 by base panel 2. Thus, the keyboard is constructed such that membrane 4A is not pressed by housing 6A, and that the expansion and shrinkage of membrane sheet 4A in case of large variation of temperature or humidity can be tolerated.

Figure 4:
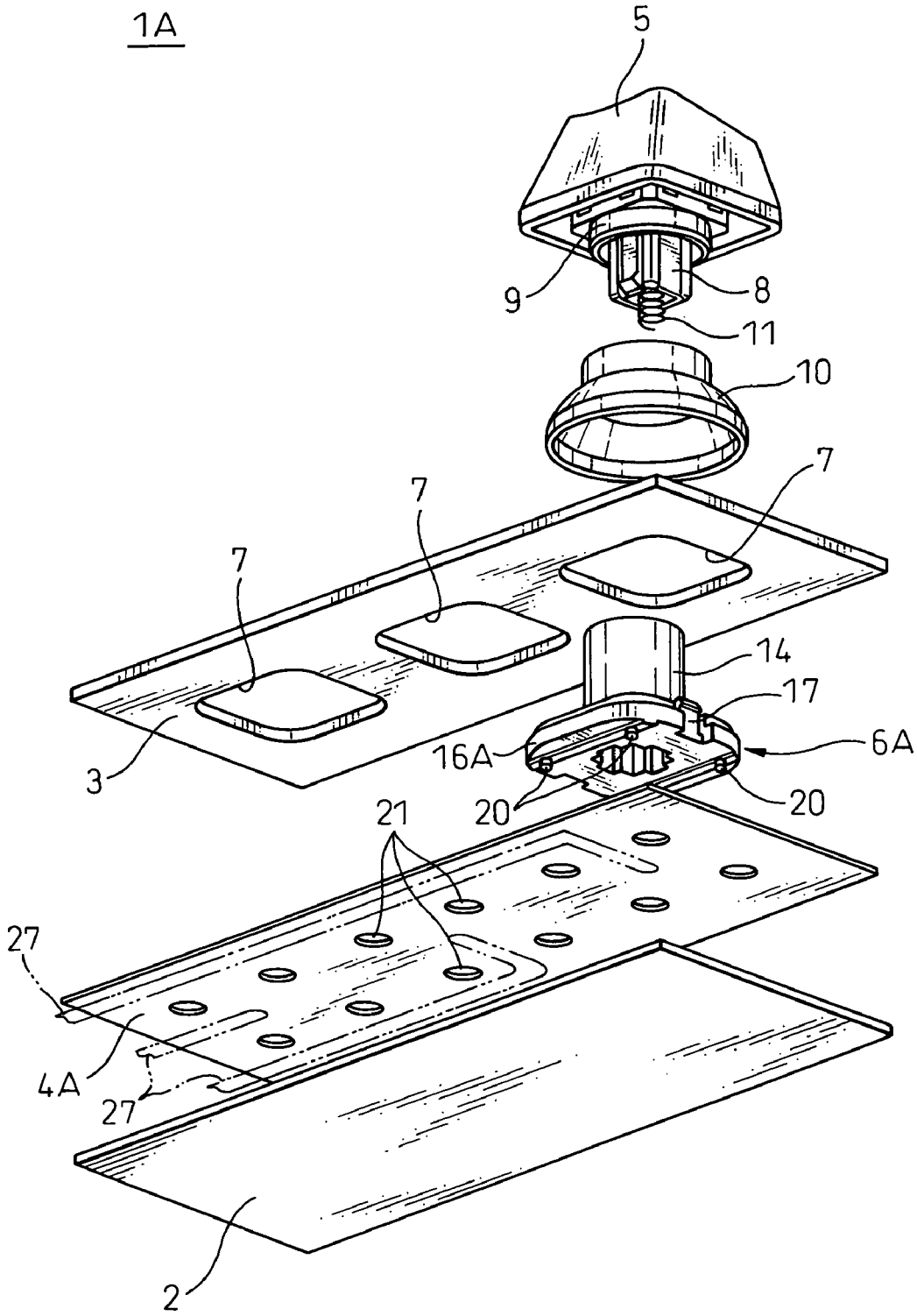
FIG. 4 is an exploded perspective view of a keyboard according to a second embodiment of the present invention.
Figure 5:
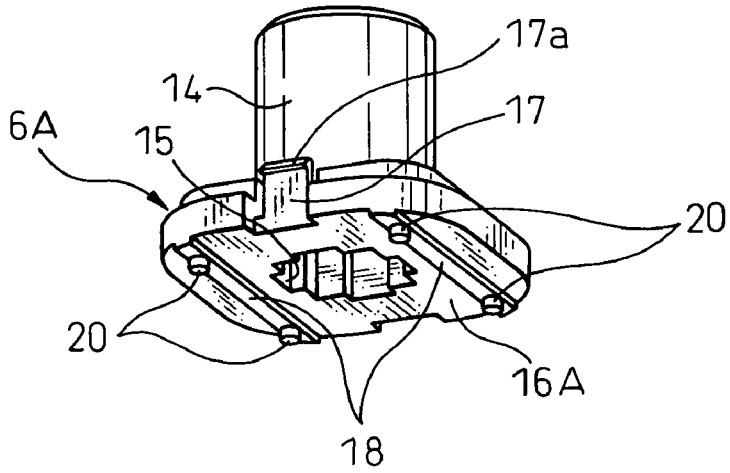
FIG. 5 is a perspective view of the housing shown in FIG. 4 as seen from below.
Figure 6:
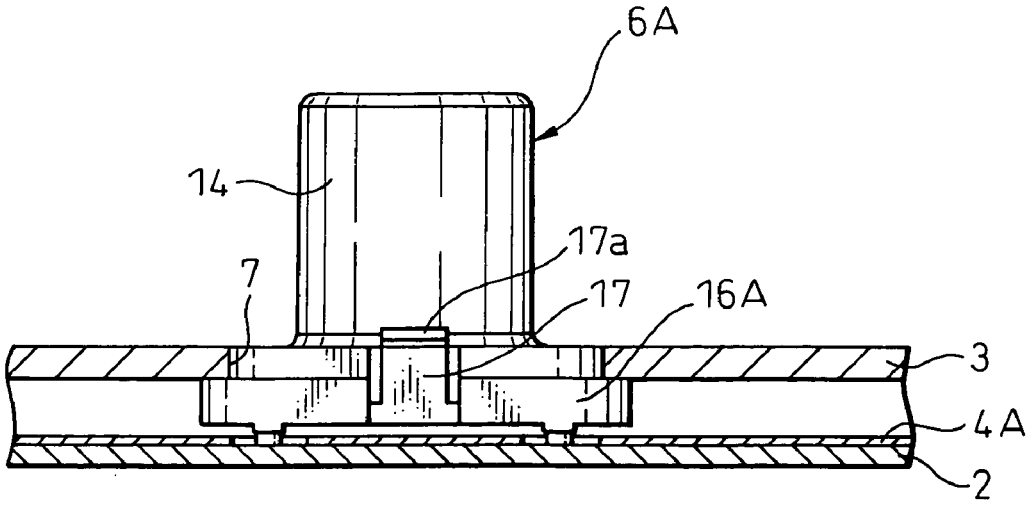
FIG. 6 is a sectional view of the housing attached to the back surface of the switch panel.
Figure 7:
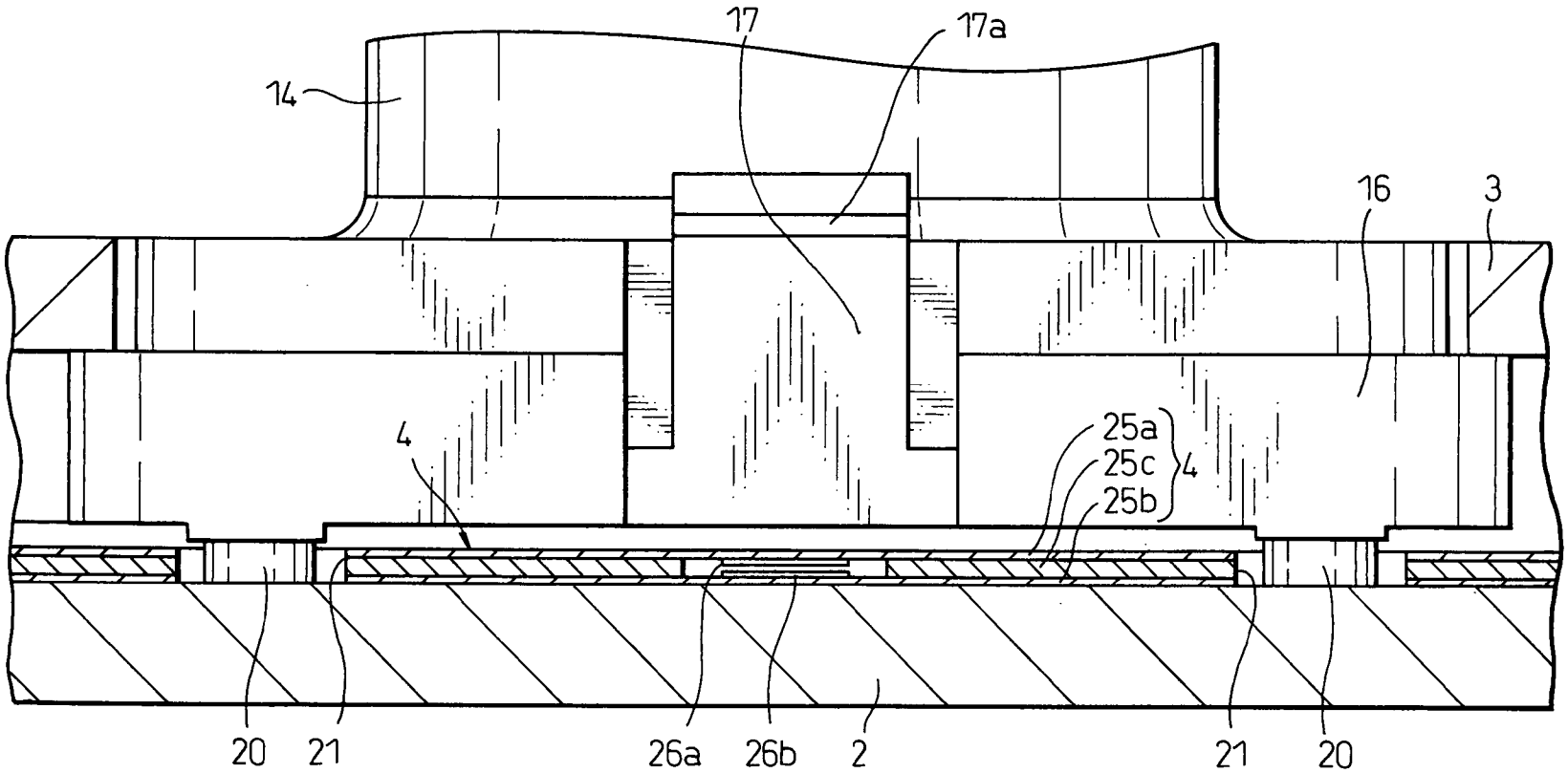
FIG. 7 is an enlarged view of a portion of the housing fixed to the switch panel.

As shown in FIGS. 4 and 5, four leg portions 20 are provided and project downward on the square lower surface of flange portion 16A at positions in rotational symmetry with respect to the center. The projecting length of leg portion 20 is longer than the thickness of membrane sheet 4A, as shown in FIGS. 6 and 7. Insertion holes 21 of diameter sufficiently larger than the diameter of leg portion 20 are formed in membrane sheet 4A at positions corresponding to four leg portions 20. Membrane sheet 4A is not tightly sandwiched between the lower surface of housing 6A and membrane sheet 4A, and expansion and shrinkage of membrane sheet 4A is tolerated.

As shown in FIG. 7, membrane sheet 4A has a laminated structure, and comprises upper electrode sheet 25*a*, lower electrode sheet 25*b*, and insulating sheet 25*c* sandwiched between upper and lower electrode sheets 25*a*, 25*b*. On the opposing surfaces of upper and lower electrode sheets 25*a*, 25*b*, a pair of contact portions 26*a*, 26*b* is provided at a position of the lower side of housing 6A supporting key top 5 and at a position corresponding to stem 8 of key top 5. Contact portions 26*a*, 26*b* are electrically connected to circuit body 27 disposed on the lower surface of membrane sheet 4A. When electrode sheet 25*a* is pressed by stem 8 of key top 5, a pair of contact portions 26*a*, 26*b* comes into contact with each other to turn the switch ON, and when the finger leaves key top 5 and a pair of contact portions 26*a*, 26*b* is separated, the switch is turned OFF.

In case where housing 6A that supports key top 5 is provided as individual piece for each key top 5 as in the present embodiment, approximately 100 pieces of housings 6A are required for assembling a keyboard, and if housing 6A needs to be attached in a specified definite orientation, assembling of the keyboard may require considerable time. In the present embodiment, however, the shape of housing 6A has rotational symmetry with respect to the center axis, that is, tube portion 14 is cylindrical and flange portion 16A is a square, so that housing 6 needs not be in a specified definite orientation in attaching, and housing 6A may be mounted easily. Strictly speaking, the housing may be attached in any of the four orientations rotated by 90°, 180°, 270° and 360°. Although flange portion 16A is a square in the present embodiment, same effect can be obtained with flange portion 16A formed in the shape of a regular polygon.

Although leg portions 20 are provided at four positions of the lower surface of flange portion 16A in the present embodiment, the number of leg portions 20 is not limited to four, and may be two, or three, as long as housing 6A can be stably supported on base panel 2. If, however, leg portions 20 are provided at two positions in diagonal direction of square flange portion 16A, and same number of insertion holes 21 are provided in membrane sheet 4A, housing 6A needs to be attached in definite orientation in which leg portions 20 coincides with insertion holes 21 in position, so that assembling of keyboard 1A may require considerable time. In such a case, it is also possible not to provide same number of insertion holes 21 as leg portions 20, but to provide four insertion holes. Thus, housing 6A may be rotated less in order to position leg portions 20 to insertion holes 21, and the degree of freedom of attaching housing 6A can be increased.

As has been described above, in accordance with the second embodiment, leg portions 20 are formed on the lower surface of flange portion 16A and insertion holes 21 are formed in membrane sheet 4A for inserting leg portions 20, so that membrane sheet 4A can be constructed so as not to be pressed by housing 6A even when flange portion 16A of housing 6A is between switch panel 3 and membrane sheet 4A, and even if variation of temperature or humidity is large, expansion and shrinkage of membrane sheet 4A can be tolerated. Thus, reliability of contact of the upper and the lower sheet electrode portions of membrane sheet 4A can be increased.

The invention claimed is:

1. A keyboard comprising:

a base panel;

a switch panel disposed on an upper surface side of said base panel, having a hole portion at predetermined position;

a membrane sheet disposed between said base panel and said switch panel, having a contact portion;

a key top adapted to be depressed for switching said contact portion ON and supported on an upper surface of said switch panel; and a stepped tubular housing supporting and guiding said key top to move freely in a vertical direction, having a tube portion on an upper end side having a guide hole formed for inserting a stem that is formed integrally with said key top, and a flange portion on a lower end side extending laterally around the tube portion in a size larger than said hole portion;

wherein said housing is inserted into said hole portion from a back side of said switch panel, said flange portion being attached to the back side of said switch pane, and wherein said housing is securely supported on said base panel by said flange portion sandwiched between said switch panel and said base panel.

2. A keyboard, comprising:

a base panel;

a switch panel disposed on an upper surface side of said base panel, having a hole portion at a predetermined position;

a membrane sheet disposed between said base panel and said switch panel, having a contact portion;

a key top adapted to be depressed for switching the contact portion ON and supported on an upper surface of said switch panel; and a stepped tubular housing supporting and guiding said key top to move freely in a vertical direction, having a tube portion on an upper end side with a guide hole accepting a stem that is formed integrally with said key top, and a flange portion on a lower end side extending laterally around the tube portion in a size larger than the hole portion, said stepped tubular housing inserted into the hole portion from a back side of said switch panel and the flange portion attached to a back side of said switch panel, wherein a plurality of leg portions capable of abutting to said base panel are provided on a lower surface of said flange portion, and a plurality of insertion holes for inserting the leg portions are provided in said membrane sheet at positions corresponding to said leg portions, and wherein a length of each leg portion is larger than a thickness of said membrane sheet.

3. A keyboard as set forth in claim 2, wherein at least two leg portions are provided at at least two positions that are rotationally symmetric with respect to a center of said flange portion.

4. A keyboard as set forth in claim 3, wherein said flange portion is in a shape of a square, and two or four leg portions are provided so as to form each pair in each diagonal direction of said flange portion, and wherein said insertion hole is respectively provided at four positions capable of accommodating said two or four leg portions.

* * * * *

UNITED STATES PATENT AND TRADEMARK OFFICE

CERTIFICATE OF CORRECTION

PATENT NO. : 8,399,789 B2
APPLICATION NO. : 12/379934
DATED : March 19, 2013
INVENTOR(S) : Takeshi Nishino et al.

It is certified that error appears in the above-identified patent and that said Letters Patent is hereby corrected as shown below:

In the Claims

Column 6, Line 57, In Claim 1, delete "pane," and insert -- panel, --, therefor.

Signed and Sealed this
Sixteenth Day of July, 2013

Teresa Stanek Rea
*Acting Director of the United States Patent and Trademark Office*